US007355552B2

(12) United States Patent
Kwon

(10) Patent No.: US 7,355,552 B2
(45) **Date of Patent: *Apr. 8, 2008**

(54) CHARACTER PATTERN ANTENNA

(75) Inventor: Jae-Yong Kwon, Seoul (KR)

(73) Assignee: LG Electronics Inc., Seoul (KR)

( * ) Notice: Subject to any disclaimer, the term of this patent is extended or adjusted under 35 U.S.C. 154(b) by 212 days.

This patent is subject to a terminal disclaimer.

(21) Appl. No.: 11/236,108

(22) Filed: Sep. 26, 2005

(65) Prior Publication Data

US 2006/0066491 A1 Mar. 30, 2006

(30) Foreign Application Priority Data

Sep. 24, 2004 (KR) ..... 10-2004-0077468

(51) Int. Cl.
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS 5,734,350 A * 3/1998 Deming et al. ..... 343/700 MS
5,926,139 A * 7/1999 Korisch ..... 343/702
6,473,044 B2 * 10/2002 Manteuffel et al. ..... 343/702
6,542,126 B2 * 4/2003 Bahr et al. ..... 343/702
6,741,214 B1 * 5/2004 Kadambi et al. .... 343/700 MS

FOREIGN PATENT DOCUMENTS

KR 1020020091789 12/2002

* cited by examiner

*Primary Examiner*—Tan Ho
(74) *Attorney, Agent, or Firm*—Lee, hong, Degerman, Kang & Schmadeka

(57) ABSTRACT

The present invention relates, in general, to antennas formed in the pattern of characters and, more particularly, to a character pattern antenna, in which a radiation unit thereof is formed in the pattern of a plurality of characters. The character pattern antenna includes a radiation unit, a feeding unit, and a short circuit unit. The radiation unit is formed in a character pattern group to radiate radio waves. The feeding unit is formed on a predetermined portion of the character pattern to provide current. The short circuit unit is formed on a predetermined location of the radiation unit and adapted to function as a ground. As described above, the present invention proposes a character pattern antenna, which allows the pattern thereof to contain a specific meaning while having the performance of an antenna. Accordingly, the present invention is advantageous in that it can increase the freedom of a pattern when an antenna is designed, thus facilitating the design of the antenna.

20 Claims, 4 Drawing Sheets

CHARACTER PATTERN ANTENNA

CROSS REFERENCE TO RELATED APPLICATIONS

Pursuant to 35 U.S.C. § 119(a), this application claims the benefit of earlier filing date and right of priority to Korean Patent Application No. 10-2004-0077468, filed on Sep. 24, 2004, the content of which is hereby incorporated by reference herein in its entirety.

DESCRIPTION OF THE RELATED ART

Recently, with the development of technology for mobile communication and data communication, various types of antennas have been proposed as antennas for communication systems. In addition to the various types of antennas, the necessity of embedding an antenna in a device has increased in consideration of the trend of communication devices toward lightness, thinness and compactness, and the good appearance of products. Therefore, since the nineteen-ninetieth, research on and technological development of embedment-oriented small-sized antennas have been continuously conducted. In particular, an Inverted F-Antenna, which includes a ground plane, a radiation or resonator plane, a feeding point, and a short circuit conductor and causes resonance at a specific frequency through the electromagnetic coupling between the radiation or resonator plane and the ground plane, has attracted attention as a small-sized antenna. Currently, an IFA application structure is most widely applied to small-sized antenna systems. In particular, a planar-IFA is universally applied.

SUMMARY OF THE INVENTION

Accordingly, the present invention has been made keeping in mind the above problems occurring in the prior art, and an object of the present invention is to provide a character pattern antenna, which improves the limitation of a conventional antenna shape, such as a meander line or the shape of a combination of slots, and in which is implemented as a character pattern, thus providing specific meaning.

In order to accomplish the above object, the present invention, provides an antenna formed in a character pattern, comprising a radiation unit formed in a character pattern group to radiate radio waves, a feeding unit formed on a predetermined portion of the character pattern to provide current, and a short circuit unit formed on a predetermined location of the radiation unit and adapted to function as a ground.

Preferably, the character pattern group may be formed by connecting two or more character patterns to each other.

Preferably, the radiation unit may further comprise an auxiliary shape formed between respective character patterns, and each of the character patterns may be one character selected from among letters of respective languages, Hangul letters, numerals and special symbols, and may be implemented using a single-stroke character or multi-stroke character.

Preferably, the character pattern implemented using the single stroke character may determine a resonant frequency by adjusting a length of the character pattern, and the character pattern implemented using the multi-stroke character may determine a bandwidth by adjusting a location of the character pattern coupled to another character pattern. Preferably, the character pattern implemented using the multi-stroke character may further extend a bandwidth by determining a branch point of additional strokes of the multi-stroke character.

Preferably, each of the character patterns may be implemented using a laterally or vertically symmetrical character. Further, the radiation unit implemented using the symmetrical character causes multi-resonance depending on a location of the feeding unit.

Preferably, each of the character patterns may be formed to be bent or to include a shape of a hole.

Preferably, the radiation unit may further comprise a dielectric support for supporting the antenna or adjusting frequency characteristics of the antenna. Preferably, the character pattern group of the radiation unit may exhibit a specific meaning.

Preferably, the radiation unit may be formed to be inclined with respect to a surface of a board.

DESCRIPTION OF THE PREFERRED EMBODIMENTS

Figure 1:
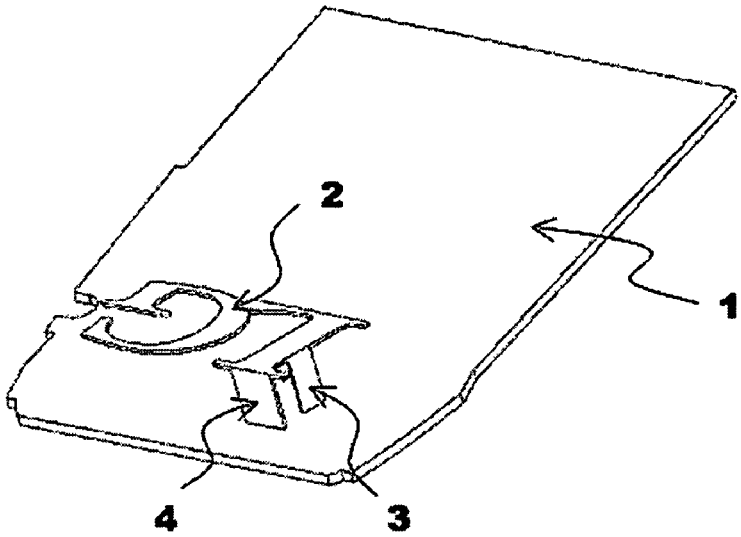
FIG. 1 is a perspective view showing a character pattern antenna according to an embodiment of the present invention.

Hereinafter, embodiments of the present invention will be described in detail with reference to the attached drawings. Reference now should be made to the drawings, in which the same reference numerals are used throughout the different drawings to designate the same or similar components. In the following description of the present invention, detailed descriptions may be omitted if it is determined that the detailed descriptions of related well-known functions and construction may make the gist of the present invention unclear.

Figure 2:
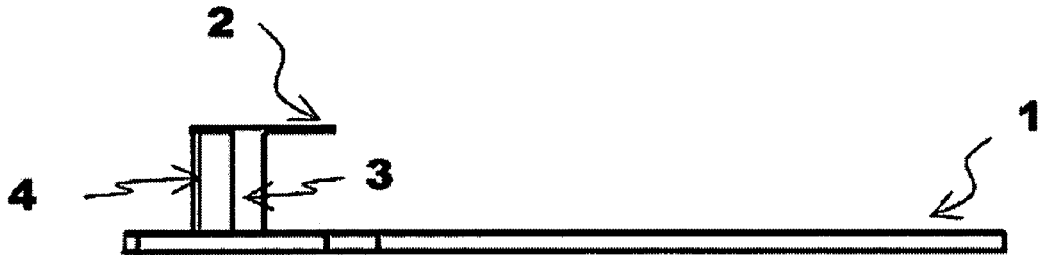
FIG. 2 is a side view showing the character pattern antenna according to the embodiment of the present invention.
Figure 3:
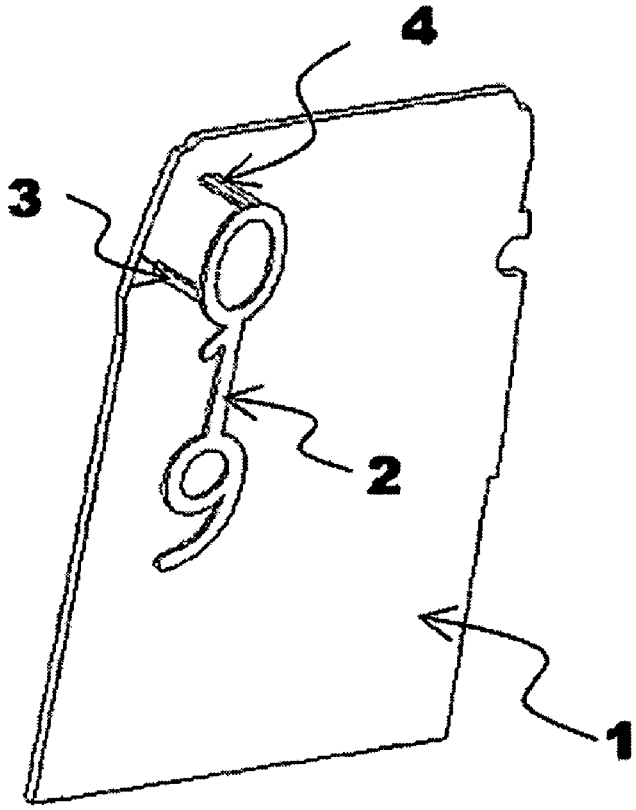
FIG. 3 is a perspective view showing a character pattern antenna according to another embodiment of the present invention.

FIGS. 1 to 3 are views showing an antenna formed in the pattern of characters according to an embodiment of the present invention.

In the embodiment, the antenna includes a Printed Circuit Board (PCB) 1, a radiation unit 2, a feeding unit 3 and a short circuit unit 4.

The embodiment schematically shows a method of forming the antenna on the PCB 1.

Referring to FIGS. 1 to 3, the radiation unit 2 of the antenna may be formed in typical known characters, for example, by the combination of English letters or numerals, as shown in FIGS. 1 and 3. The shape of the combination can vary as in a specific language letter 1 (for example, English)+specific language letter 2 (for example, Hangul)+numeral or specific language letter+specific symbol (for example: a trademark), etc. In particular, when the combination of characters becomes a word having a specific meaning or a specific firm name (for example, LG, GE or SAMSUNG), the radiation unit 2 may have a specific meaning that a simple radiation unit does not have.

The basic length of the radiation unit 2 is determined depending on the center frequency of the antenna, and the shape and interval of characters that constitute the radiation unit 2 are adjusted, so that the antenna can be tuned to an antenna having a specific center frequency and a specific frequency bandwidth. In this case, the width and length of the antenna radiation unit 2, and the distance between conductors of the radiation unit 2 are important design factors, and are influenced by the scale, inclination or spacing of the font of specific characters constituting the radiation unit 2.

Figure 4A:
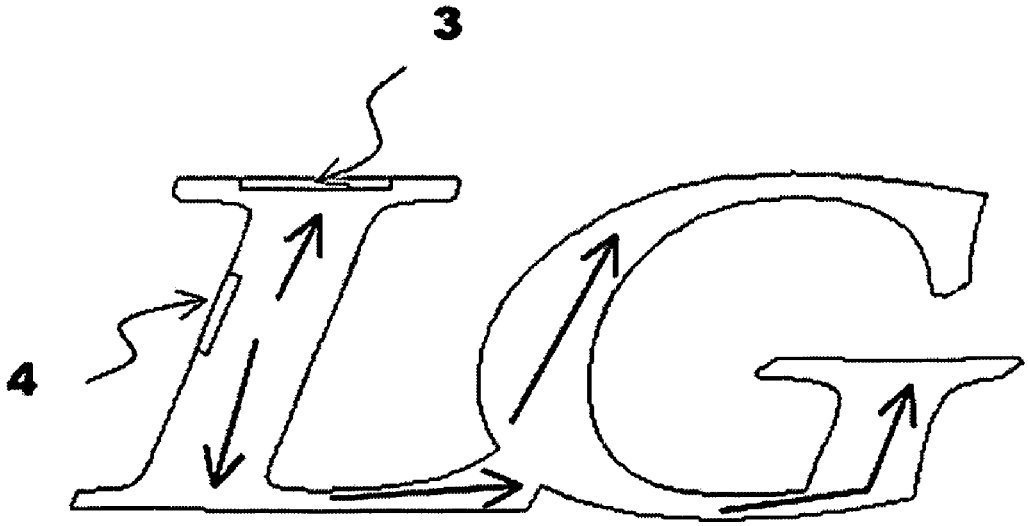
FIGS. 4*a* and 4*b* are views showing the characteristics of an antenna according to the character pattern of a radiation unit according to embodiments of the present invention.
Figure 4B:
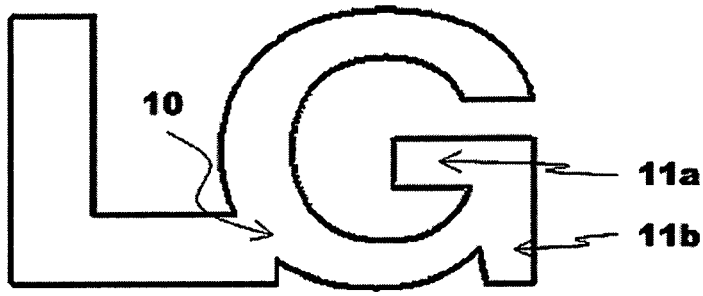

FIGS. 4*a* and 4*b* are views showing the characteristics of an antenna according to the character pattern (or character pattern group) of the radiation unit 2 according to embodiments of the present invention.

FIGS. 4*a* and 4*b* illustrate the embodiments of the radiation unit 2, in which the combination of characters "LG" has the antenna characteristics of a specific frequency band using only the shape thereof and enables the conveyance of the meaning of a specific trademark. In the drawings, since respective embodiments are implemented using different styles of characters and have different scales and character spacings, the electromagnetic characteristics of the radiation units 2 of the antennas are different from each other even though the meanings of characters are the same.

The locations of the feeding unit 3 and the short circuit unit 4 must be considered as shown in FIG. 4*a* so that a current path can be formed in the radiation unit 2 implemented using a character pattern (or character pattern group) in consideration of the operating frequency of the antenna. The bandwidth characteristics of the antenna depend on the width of a character pattern and the shape of characters, so that the width of a character pattern and the shape of characters must be suitably selected in conformity with the characteristics of the antenna.

That is, single stroke characters, such as "L, N, W, S or 7" may greatly influence the determination of the operating frequency of the antenna, and multi-stroke characters, such as "G, K, B or 4", may greatly influence the determination of the bandwidth characteristics of the antenna. Therefore, character patterns are suitably combined, so that desired frequency characteristics can be obtained. In this case, a current path may be changed depending on the shape of the coupling of characters, so that character coupling also becomes an important factor for determining the pattern of the antenna proposed in the present invention. For example, in character patterns shown in FIGS. 4*a* and 4*b*, a character "L" mainly contributes to the provision of a current path for the resonance of the antenna, and a character "G" forms two current paths depending on its location 10 coupled to the character "L", thus widening the bandwidth of the antenna. Further, additional branches 11*a* and 11*b* of a stroke further widen the bandwidth.

Figure 5A:
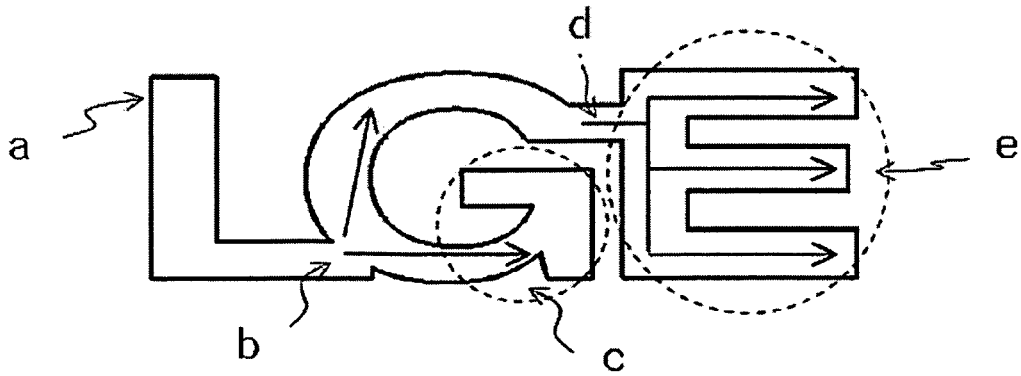
FIGS. 5*a* and 5*b* are views showing a method of forming a bandwidth and a resonance point according to a character pattern according to other embodiments of the present invention.
Figure 5B:
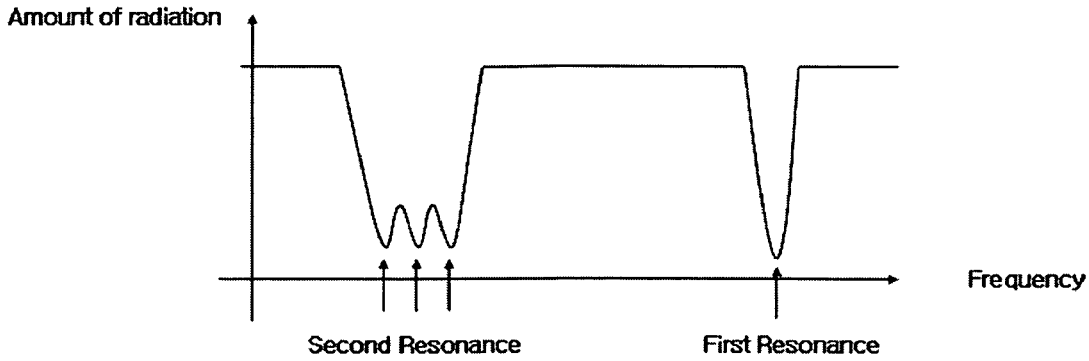

FIGS. 5*a* and 5*b* are views showing a method of forming a bandwidth and a resonance point according to a character pattern according to other embodiments of the present invention.

Existing characters (for example, English letters) can be classified into three types according to shape (notice: they can vary depending on the style of characters, or whether they are capital letters or small letters) as follows. Further, if it is assumed that characters are antenna patterns and are fed, the electromagnetic characteristics thereof exhibit the following features depending on classification.

First, there is classification according to stroke, in which characters are classified into single stroke letters and multi-stroke letters.

The single stroke letters may include the letters C, I, L, W, Z, etc., and each form a single current path when one end of each letter is fed, so that the length of the stroke of the letter forms a current path for determining the resonant frequency of the antenna.

The multi-stroke letters may include the letters E, F, G, K, H, Y, etc., in which the current path thereof is divided according to the shape of strokes when one end of each letter is fed, so that the antenna has multi-resonance characteristics.

Second, there is classification according to symmetry. In this case, characters are classified into laterally or vertically symmetrical letters and asymmetrical letters.

The laterally or vertically symmetrical letters may include the letters A, E, H, W, X, etc., in which a plurality of current paths, having the same length, may be formed when a single point on an axis of symmetry is fed, thus improving resonance characteristics. If the feeding point is set to deviate slightly from the axis of symmetry, multi-resonance occurs in adjacent locations, thus widening the bandwidth.

The asymmetrical letters may include the letters G, K, P, Q, R, etc., and may exhibit different characteristics depending on the feeding location of a stroke, so that the resonant frequency of the antenna can be adjusted by the combination of an asymmetrical letter and a single stroke letter.

Last, there is classification according to loop, which is defined depending on whether the shape of a letter includes a hole.

Closed letters may include the letters A, O, P, Q, R, etc. The shape of each closed letter includes a hole, so that the antenna can utilize electromagnetic effects caused by the hole, such as by adjusting the amount of radiation using the length, width and angle of the hole.

FIG. 5*b* is a graph showing a frequency having a resonance point formed by the character pattern of FIG. 5*a*.

If the character pattern of FIG. 5*a* is examined with reference to the above description, the above-described antenna pattern is composed of a single stroke asymmetrical letter "L", a multi-stroke asymmetrical letter "G", and a multi-stroke symmetrical letter "E", based on the classification criteria proposed above. In this case, if the feeding point "a" is placed at an end of the letter "L" as shown in FIG. 5*a*, the single stroke letter "L" mainly functions to ensure a current path for resonance, as described above. As the letter "L" is coupled to the multi-stroke asymmetrical letter "G" at a location "b", the current path branches, and then a part "c" of the multi-stroke asymmetrical letter "G" forms a first resonance point, as shown in the graph. Another part of the letter "G" is coupled to the multi-stroke symmetrical letter "E" through a coupling structure "d", and feeding is conducted at a location deviating from the point of symmetry, as described above. Accordingly, three different branch current paths "e" are formed, so that adjacent consecutive resonances having low frequency differences therebetween occur, thereby a second resonance point, which is entirely, widely distributed, is formed, as shown in FIG. 5*b*.

Figure 6:
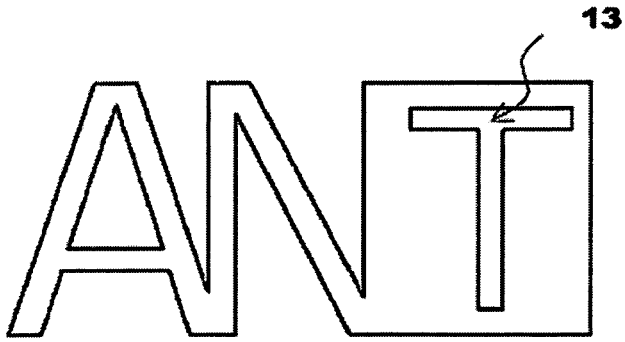
FIG. 6 is a plan view showing a character pattern antenna, in which a character pattern is formed to include the shape of a hole, according to an embodiment of the present invention.

FIG. 6 is a view showing an antenna pattern in which a character pattern is formed to partially include the shape of a slot 13. If necessary, a character pattern may be formed to have a hole, as shown in FIG. 6.

In the radiation unit, a mounting hole or support (not shown) may be formed for convenience of mounting of the antenna if necessary. Further, the radiation unit may have an inclined shape or stepped shape having different heights, without having a uniform height.

Figure 7:
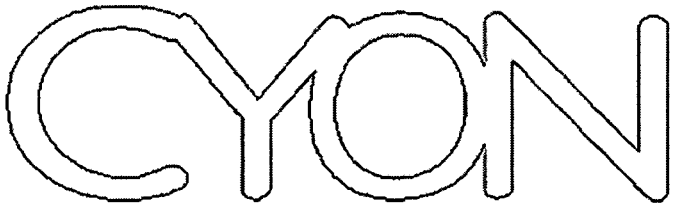
FIG. 7 is a plan view showing a character pattern antenna according to yet another embodiment of the present invention.

In the radiation unit of the character pattern of FIG. 7, if necessary, the entire character pattern "CYON" may be formed to be inclined, or only the pattern of a letter "Y" may be placed on an inclined surface to allow the letters "C" and "ON" to be formed at different heights.

As described above, the present invention proposes a character pattern antenna, which allows the pattern thereof to contain a specific meaning while having the performance of an antenna. Accordingly, the present invention is advantageous in that it can increase the freedom of a pattern when an antenna is designed, thus facilitating the design of the antenna.

Further, the present invention can be applied to all fields in which an antenna is utilized, so that the antenna can contain a specific meaning or symbolism without being restrictedly used only as a part of a system.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An antenna formed in a character pattern, comprising:

a radiation unit having a multi-stroke character pattern group to radiate radio waves;

a feeding unit formed on a predetermined portion of the character pattern to provide current; and a short circuit unit formed on a predetermined location of the radiation unit and adapted to function as a ground.

2. The character pattern antenna according to claim 1, wherein the character pattern group is formed by connecting two or more character patterns to each other.

3. The character pattern antenna according to claim 2, wherein the radiation unit further comprises an auxiliary shape formed between respective character patterns.

4. The character pattern antenna according to claim 2, wherein each of the character patterns is one character selected from among letters of respective languages, Hangul letters, numerals and special symbols.

5. The character pattern antenna according to claim 2, wherein each of the character patterns is implemented using a multi-stroke character.

6. The character pattern antenna according to claim 5, wherein the multi-stroke character pattern determines a bandwidth by adjusting a location of the character pattern coupled to another character pattern.

7. The character pattern antenna according to claim 5, wherein the multi-stroke character pattern further extends a bandwidth by determining a branch point of additional strokes of the multi-stroke character.

8. The character pattern antenna according to claim 2, wherein each of the character patterns is implemented using a laterally or vertically symmetrical character.

9. The character pattern antenna according to claim 8, wherein the radiation unit implemented using the symmetrical character causes multi-resonance depending on a location of the feeding unit.

10. The character pattern antenna according to claim 8, wherein the symmetrical character comprises E and H.

11. The character pattern antenna according to claim 2, wherein each of the character patterns is formed to be bent.

12. The character pattern antenna according to claim 2, wherein each of the character patterns is implemented using an asymmetrical character.

13. The character pattern antenna according to claim 12, wherein the asymmetrical character comprises G and K.

14. The character pattern antenna according to claim 1, wherein each of the character patterns is formed to include a shape of a slot.

15. The character pattern antenna according to claim 1, wherein the radiation unit further comprises a dielectric support for supporting the antenna or adjusting frequency characteristics of the antenna.

16. The character pattern antenna according to claim 1, wherein the character pattern group of the radiation unit exhibits a specific meaning.

17. The character pattern antenna according to claim 1, wherein the radiation unit is formed to be inclined with respect to a surface of a board.

18. The character pattern antenna according to claim 1, wherein the multi-stroke character comprises 4, B, E, F, G, K, H, and Y.

19. The character pattern antenna according to claim 1, wherein the radiation unit comprises an inclined shape or a stepped shape having different heights.

20. The character pattern antenna according to claim 1, wherein the character pattern is formed to have a hole.

* * * * *